US005988597A

United States Patent [19]

Egan

[11] Patent Number: 5,988,597

[45] Date of Patent: Nov. 23, 1999

[54] UNIT DOLLY AND METHOD OF USE

[76] Inventor: Robert Egan, 5103 Tiffany, Houston, Tex. 77045

[21] Appl. No.: 08/958,183

[22] Filed: Oct. 27, 1997

[51] Int. Cl.[6] ..... B66D 1/26; B66D 3/00

[52] U.S. Cl. ..... 254/279; 254/4 R; 414/426; 414/460

[58] Field of Search ..... 254/279, 280, 254/281, 323, 380, 4 R, 4 B, 4 C, 47; 414/460, 426, 427, 428; 27/32

[56] References Cited

U.S. PATENT DOCUMENTS

| | | | |
|---|---|---|---|
| 1,099,363 | 6/1914 | Hefner | 254/4 R |
| 1,481,049 | 1/1924 | Cason | 254/279 |
| 1,675,362 | 7/1928 | Ledyard et al. | 254/279 |
| 2,039,464 | 5/1936 | Troup | 27/32 |
| 2,262,937 | 11/1941 | Holmes | 254/279 |
| 2,528,672 | 11/1950 | Sullivan . | |
| 2,657,938 | 11/1953 | Browne et al. . | |
| 2,679,329 | 5/1954 | Stout . | |
| 2,706,057 | 4/1955 | Belding . | |
| 3,075,603 | 1/1963 | Baudhuin | 414/460 |
| 3,329,284 | 7/1967 | Bogart . | |
| 3,831,791 | 8/1974 | Gonzales . | |
| 4,078,759 | 3/1978 | Lanier | 414/426 |
| 4,491,452 | 1/1985 | Matovich . | |
| 4,693,660 | 9/1987 | LaCroix | 254/4 R |
| 4,897,011 | 1/1990 | Brower . | |

*Primary Examiner*—John M. Jillions

[57] ABSTRACT

A unit dolly having a detachable rectangular box frame with left and right side members and front and back members, each member having top and bottom members interconnected by vertical support posts, including four winches and lifting means for hoisting heavy or cumbersome objects, and a method for using the unit dolly.

6 Claims, 4 Drawing Sheets

UNIT DOLLY AND METHOD OF USE

FIELD OF THE INVENTION

The subject invention is related to an apparatus and method for hoisting objects to be moved. The subject invention is more directly related to an apparatus that can be disassembled, transported to a location where it is to be used, and then reassembled, and a method for assembling the apparatus and for hoisting objects to be moved. The subject invention is further related to a method whereby the apparatus is disassembled, transported, reassembled and used to hoist objects to be moved by a single individual.

BACKGROUND OF THE INVENTION

Various types of lifting or hoisting devices are well known in the prior art and include hoists and jacks, which may be used in combination with various scaffolds and/or platform mechanisms. Hoisting devices are used when an object to be moved is either too heavy or bulky to be relocated by human power alone. Many hoisting devices exist which are capable of lifting and moving heavy or bulky objects throughout easily accessible areas, such as warehouses, garages or construction sites. Typically, an object in a warehouse, garage or construction site is at or close to grade; objects close to grade are easy for current hoisting devices to reach, hoist and move. However, there is considerable room for improvement in the field of suitable apparatus or methods capable of reaching, hoisting and moving objects that reside high above grade or in a generally inaccessible area.

The prior art includes various types of lifting or hoisting devices, each of which provides certain advantages in use or construction.

The prior art includes devices for lifting and transporting heavy and awkward objects such as raw materials in metal fabrication shops. The raw materials being too heavy for conventional fork lifts, or having dimensions that make it impossible for transportation on a fork lift through narrow warehouse passageways. One such device is taught by U.S. Pat. No. 2,679,329. The device of U.S. Pat. No. 2,679,329 comprises a primary unit and a secondary unit, each having a lifting means connected to a frame wherein the frame members are all rigidly fabricated to one another. The secondary unit is to be attached to the primary unit when necessary to transport materials exceeding the length of the primary unit. Both the primary and the secondary units are to be used in conjunction with a fork lift. The fork lift is a needed addition to the device and is used for loading materials onto the units, and to tow the units after loading.

The prior art also includes a device for lifting and transporting heavy and awkward objects which comprises a disc carrier attached to a trailer to be towed by a tractor. One such device is taught by U.S. Pat. No. 2,657,938. The device of U.S. Pat. No. 2,657,938 comprises a frame constructed of tubular members rigidly attached to one another. A lifting means is provided on the frame for lifting discs and wheels. The wheels provide support for the trailer and facilitate transportation of the device. This device taught by U.S. Pat. No. 2,657,938 is designed to relocate discs from one field to another. Therefore the structural members need not necessarily be designed for easy or quick disassembly, but instead can be rigidly attached to one another.

U.S. Pat. No. 2,528,672 discloses a portable lifting device used to elevate mechanical equipment and for transporting large and bulky equipment. The portable lifting device taught by U.S. Pat. No. 2,528,672 is comprised of a unibody frame structurally enhanced for bearing large loads. Connected to the frame is a winch for hoisting and maintaining at elevation large loads for relocation. Additionally connected to the frame are wheels for support and ease of movement of the device. As evident from its structural design this device was designed to be towed, in whole, to the object to be moved.

U.S. Pat. No. 3,329,284 discloses a self-propelled marine hoist for removing boats from water and placing the boats on shore for repair and storage. The apparatus of U.S. Pat. No. 3,329,284 is described as being capable of disassembly for easy shipping and reassembly at the lifting site. Certain difficulties are described in the disassembly, reassembly process such as the need for multiple personnel on hand to disassemble and reassemble the apparatus—at least one of which being required to have experience in the disassembly/reassembly process of the apparatus. U.S. Pat. No. 3,329,284 also discloses an internal combustion engine for propelling the apparatus and power for the lifting means, and suggests that this device could transport heavy machinery or other bulky loads over land from one point to another.

One current apparatus and method for relocating heavy cumbersome objects on roof tops involves a large crane. Currently crane rental is expensive and time consuming, as is the requisite manpower associated with operating a crane.

There still exists in the art a need for a lifting or hoisting device which is easily disassembled, easily transported once disassembled, easily reassembled, and exhibits flexibility of positioning, and provides four independent lift means.

SUMMARY OF THE INVENTION

According to the present invention, the foregoing and other objects are attained by a unit dolly comprising a rectangular chassis, four winches, and four lifting means. The rectangular chassis is comprised of a left side member, a right side member, a front gate member, and a back gate member and each member has a first end and a second end. The first end of the front gate member is detachably attached to the first end of the left side member. The second end of the left side member is pivotally detachably attached to the first end of the back side member. The second end of the back side member is detachably attached to the first end of the right side member. The second end of the right side member is pivotally detachably attached to the second end of the front gate member. Additionally, each of the winches provides for swiveling attachment to the top of one of the first and second ends of the right and left side members, and each of the lifting means is attached to one of the four winches.

The method for assembling the unit dolly comprises, in any order, the steps of attaching the first vertical beam of the front gate member to the first vertical post of the left side member, attaching the second vertical beam of the front gate member to the first vertical post of the right side member, and attaching the first vertical beam of the back gate to the second vertical post of said left side member. The second vertical beam of said back gate member is attached to said second vertical post of the right side member.

The method for hoisting an object to be moved with the unit dolly comprises positioning the unit dolly adjacent to an object to be moved including configuring the unit dolly to receive the object to be moved by detaching the second vertical beam of the front gate member from the first vertical post of the right side member and rotating the second vertical beam of the front gate member away from the first vertical post of the right side member until an opening is formed between the second vertical beam of the front gate member and the right side member that is capable of receiving the object to be moved, repositioning the unit dolly until the inner periphery of the unit dolly encompasses the outer periphery of the object to be moved, configuring the unit dolly to hoist the object to be moved by rotating the second vertical beam of the front gate member adjacent to the first vertical post of the right side member and rigidly attaching the second vertical beam to the first vertical post of said right side member. The object to be moved is hoisted by affixing the lifting elements to the object to be moved and then hoisting the object to be moved by activating the winches.

The side members are fully detachable from the front and back members; thus the unit dolly is capable of being easily disassembled and then easily transported to various sites and reassembled for use. The simplicity of the unit dolly allows it to be disassembled and reassembled by personnel who are not trained in the disassembly or reassembly method of the unit dolly. Additionally, due to the size and weight of the unit dolly, the component parts can be lifted to elevated locations where typical dollies cannot be used. More importantly, a single individual can disassemble the unit dolly, lift the unit dolly to some elevated location, and reassemble the unit dolly to hoist objects to be moved.

There exists in the art a need for a hoisting device which is easily disassembled, easily transported once disassembled, easily reassembled, and exhibits flexibility of positioning, and provides four independent lift means.

Accordingly, it is an object of this invention to provide a lifting or hoisting device which is easily disassembled.

It is a further object of this invention to provide a lifting or hoisting device which is easily transported once disassembled.

It is a yet further object of this invention to provide a lifting or hoisting device apparatus or method which provides ease of reassembly.

It is a yet further object of this invention to provide a lifting or hoisting device apparatus or method which exhibits flexibility of positioning It is a yet further object of this invention to provide a lifting or hoisting device apparatus or method which provides four independent lift means.

It is a yet further and final object of this invention to provide a lifting or hoisting device which is easily disassembled, easily transported once disassembled, easily reassembled, and exhibits flexibility of positioning, and provides four independent lift means.

BRIEF DESCRIPTION OF THE DRAWINGS

A better understanding of the present invention can be obtained from the detailed description of exemplary embodiments set forth below, to be considered in conjunction with the attached drawings, in which.

DETAILED DESCRIPTION OF THE INVENTION

Figure 1:
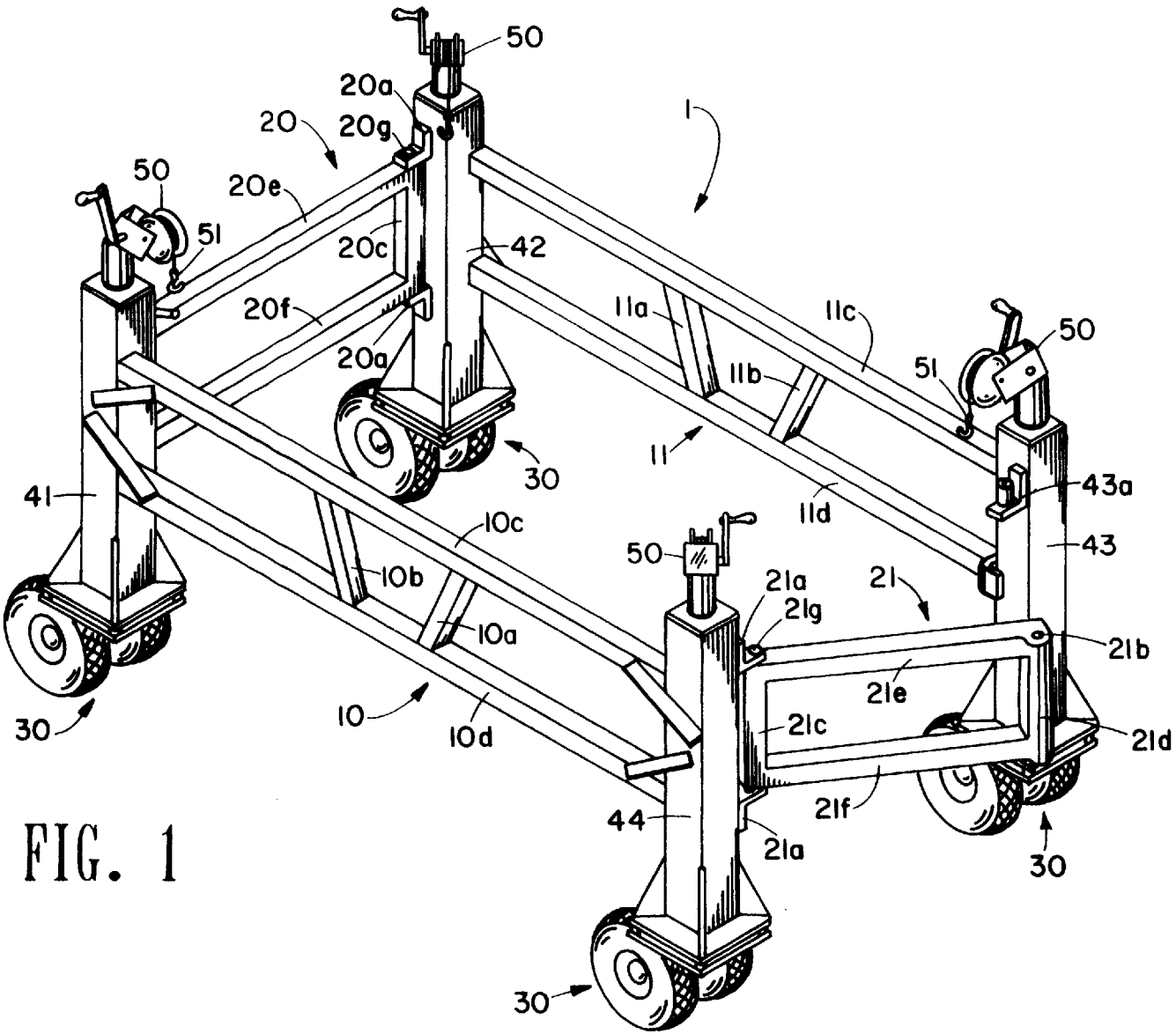
FIG. 1 is a perspective view of the unit dolly according to one embodiment of the present invention.
Figure 2:
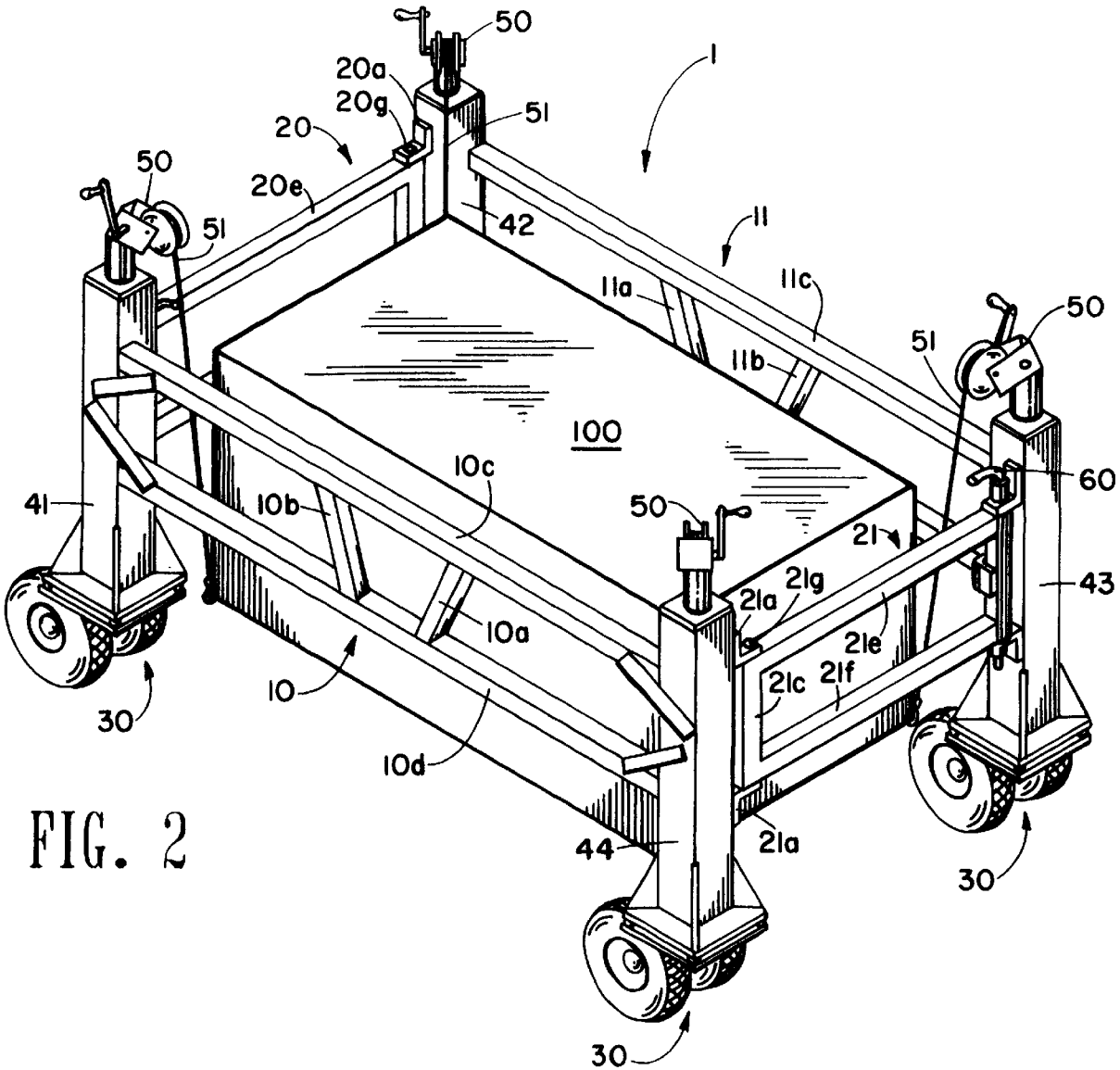
FIG. 2 is a perspective view of the unit dolly illustrating the unit dolly in use.
Figure 3:
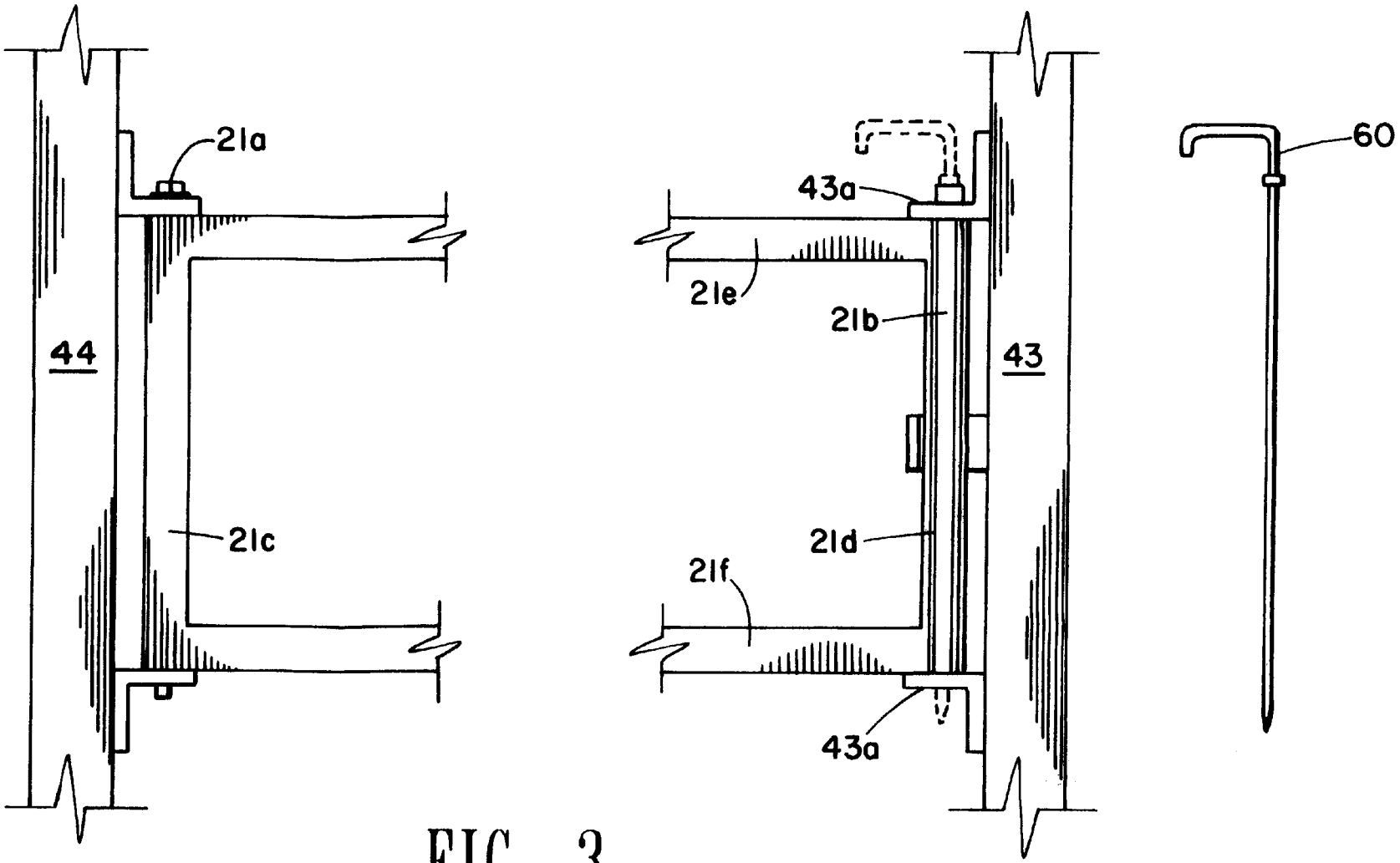
FIG. 3 is a partially exploded view of the gate latching mechanism and a gate.
Figure 4:
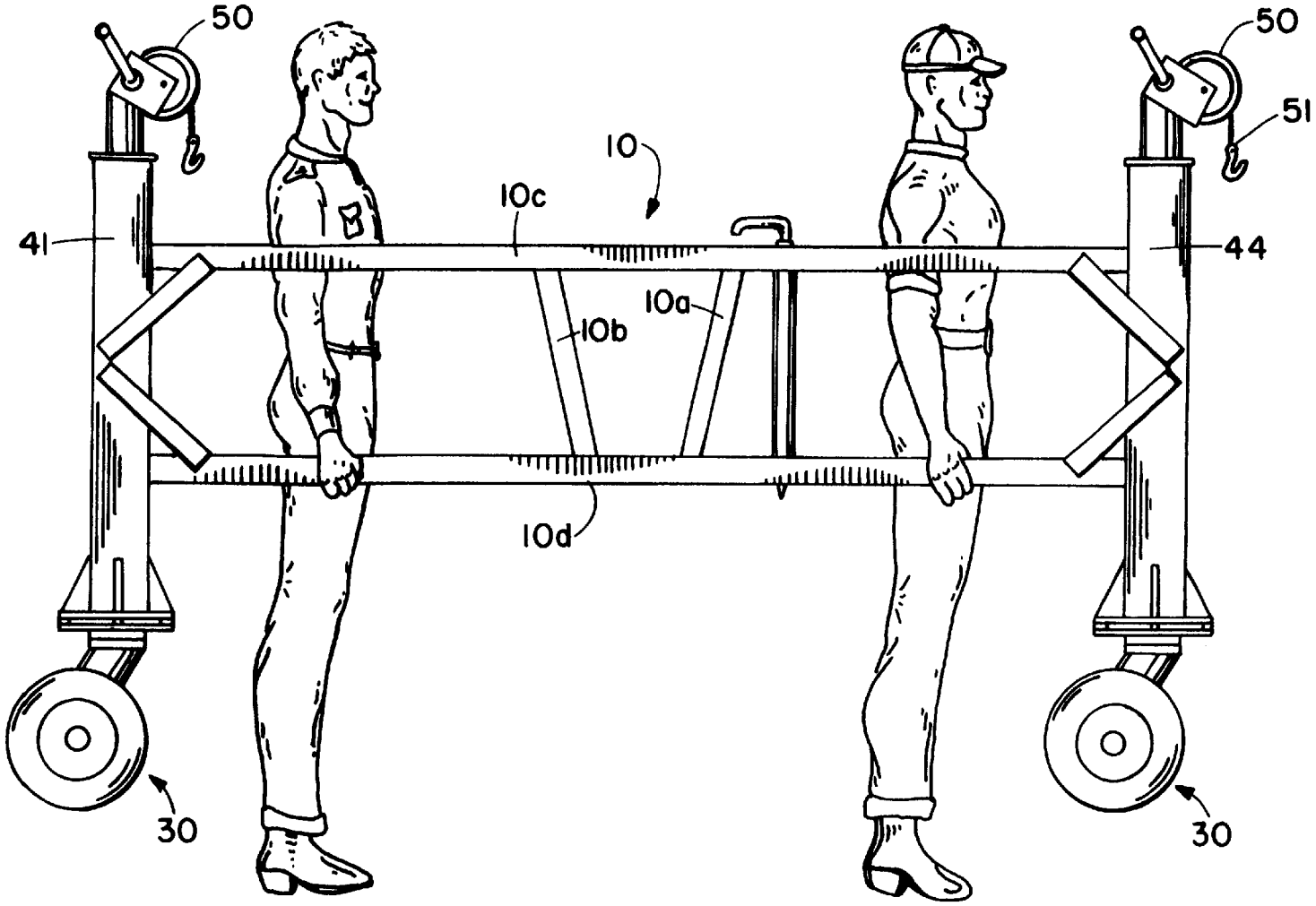
FIG. 4 depicts the disassembled left/right side of the unit dolly being transported.

FIGS. 1 and 2 illustrate, in perspective view, a preferred embodiment of the unit dolly 1 comprising a left side member 10, a right side member 11, a front gate member 21 and a back gate member 20. The left side member 10, being substantially rectangular, is comprised of a top cross member 10*c* and a bottom cross member 10*d*. The top cross member 10*c* and the bottom cross member 10*d* are preferably affixed in parallel and connected by two support members 10*a* and 10*b*. Connected at the extreme end of each cross member 10*c* and 10*d* are vertical posts 41 and 44. Welding is the preferred method of attaching the cross members 10*c* and 10*d* to the vertical posts 41 and 44, however, attachment can be accomplished by bolting the cross members 10*c* and 10*d* to the vertical posts 41 and 44, or any suitable method of construction. The right side member 11 is also substantially rectangular comprised of a top cross member 11*c* and a bottom cross member 11*d*. Top cross member 11*c* and bottom cross member 11*d* are affixed in parallel and connected by two support members 11*a* and 11*b*. Connected at the extreme end of cross members 11*c* and 11*d* are vertical posts 42 and 43. Here also welding is the preferred method of attaching cross members 11*c* and 11*d* to vertical posts 42 and 43, however bolting or any other suitable construction method may be employed. Winches 50 are affixed to the top of each vertical post 41, 42, 43, 44. Provided with each winch 50 are lifting means 51. The preferred lifting means 51 is comprised of a web strap, although any suitable material may be used, such as rope, cable or chain. The preferred method of attaching the winches 50 to the vertical posts 41, 42, 43, 44 allows each winch 50 to freely swivel in the direction of the load being lifted. Swiveling the winch 50 reduces the force necessary to raise an object, and reduces stresses on the winch 50 and the vertical posts 41, 42, 43, 44.

Wheels 30 are provided at the bottom of each vertical post 41, 42, 43, 44. The wheels 30 are allowed to swivel or caster for ease of movement of the unit dolly 1.

The front gate member 21 being substantially rectangular is comprised of a top cross member 21*e* and a bottom cross member 21*f*. Top cross member 21*e* and bottom cross member 21*f* are disposed in parallel and interconnected at their extreme ends by a first vertical beam 21*c* and a second vertical beam 21*d*. The front gate member 21 is rotatably connected to the vertical post 44 by means of hinges 21*a* attached at the top and bottom of the first vertical beam 21*c*. While hinge bolts 21*g* are the preferred method of attaching the front gate member 21 to the hinges 21*a*, other suitable methods may be used, such as rivets or a shaft and cotter pin arrangement. Attached parallel to the second vertical beam 21*d* is an elongated tube 21*b*. Attached to the vertical post 43 is an anchor coupling 43*a* having an aperture (not shown); the aperture being directed axially to the vertical post 43. Alignment of the elongated tube 21*b* under the anchor coupling 43*a* allows insertion of a pin 60 into the aperture (not shown) and through the elongated tube 21*b*. Insertion of the pin 60 secures the front gate member 21 to the vertical post 43, thus providing a rigid support and a fixed angle between the front gate member 21 and the vertical post 43. The back gate member 20 is comprised in identical fashion to front gate member 21, however the elongated tube 21*b* attached to the back gate member 20 is preferably connected to the vertical post 41 located diagonally across from the vertical post 43 instead of the vertical post 42 which is adjacent the vertical post 43. Locating the elongated tubes 21*b* in diagonal position enhances rigidity, provides for fixed angles, and improves support.

In operation, the unit dolly 1 can be disassembled by removing the pins 60 that secure the front gate member 21 and the back gate member 20. The hinge bolts 21*g* are removed from the front and back gate members 21, 20. After disassembly components of the unit dolly 1 can then be loaded onto a vehicle for transportation to a location for moving the object to be moved 100. Once the components are delivered to the appropriate site the components are then assembled. Assembly can be accomplished by aligning the elongated tube 21*b* under the anchor coupling 43*a*, then inserting the pin 60 through the aperture in the anchor coupling 43*a* and into the aperture in the elongated tube 21*b*. The left side member 10 is then affixed to the first side of the front gate member 21 and secured by insertion of the hinge bolts 21*g*. In like manner the rear gate member 20 is attached to the left side member 10 and the right side member 11. A distinct advantage of the unit dolly 1 is that if the object to be moved 100 is in an elevated location, each component part of the unit dolly 1 can be hoisted to that elevated location where the unit dolly 1 can be easily reassembled and used to move the object to be moved 100. Another advantage of the unit dolly 1 is that it can be disassembled, transported, reassembled and used by a single individual. After reassembly the unit dolly 1 is situated proximate to the object to be moved 100. The pin 60 is removed from either the front gate member 21 or the back gate member 20. The gate member 20 or 21 from which the pin 60 is removed is then opened by rotating the gate member 20 or 21 away from the unit dolly 1 about the attached hinge bolts 21*g*. Once the gate member 20 or 21 is sufficiently open to accept the object to be moved 100 the unit dolly 1 is rolled to encompass the object to be moved 100. When the outer periphery of the object 100 is encompassed by the inner periphery of the unit dolly 1, the gate member 21 or 20 is rotated toward the unit dolly 1 until the elongated tube 21*b* is under the aperture (not shown). The pin 60 can then be inserted through the aperture (not shown) and into the elongated tube 21*b* to secure the gate member 20 or 21 to the vertical post 43 or 41. Securing the gate member 21 or 20 to the vertical posts 43 or 41 produces rigid and fixed angles between each gate member 21 or 20 and adjacent side member 10 or 11 to produce a rigid sturdy frame for the unit dolly 1.

The lifting means 51 from adjacent winches 50 are positioned to hoist the object to be moved 100. While it is preferred to connect adjacent lifting means 51 and place the connected lifting means 51 under the object 100 to be moved, the lifting means 51 can also be directly affixed to the object 100 to be moved. It is preferred to adjoin the lifting means 51 from the winches 50 that are located opposite the front gate member 21 or back gate member 20. However, any suitable arrangement used to hoist the object to be moved 100 may be employed. Each winch 50 is then activated to reduce the effective length of the lifting means 51 which in turn raises the object 100 from its resting position. Once hoisted, the object to be moved 100 can now be transported on the unit dolly 1 to another desired location. The object to be moved 100 can be resituated by releasing the winches 50 to increase the length of the lifting means 51 which will lower the object 100 to be moved.

The foregoing disclosure and description of the invention is illustrative and explanatory thereof, and various changes in the size, shape, and materials, as well as in the details of the illustrated system and method may be made without departing from the spirit of the invention. Examples of such changes include, but are not limited to, a non-rectangular chassis. Such a chassis could be elliptical or trapezoidal. Additionally, the members comprising the chassis could be angular or could each have multiple degrees of freedom.

I claim:

1. A unit dolly comprising a chassis, four winches, and four lifting means, wherein said chassis is comprised of a left side member, a right side member, a front gate member, and a back gate member:

wherein each of said members provides a first end and a second end, whereby said first end of said front gate member is detachably attached to the first end of said left side member, said second end of said left side member is pivotally detachably attached to said first end of said back gate member, said second end of said back gate member is detachably attached to said first end of said right side member, and said second end of said right side member is pivotally detachably attached to said second end of said front gate member;

wherein each of said winches provides for swiveling attachment to the top of one of said first and second ends of said right and left side members; and wherein each of said lifting means is attached to one of said four winches.

2. A unit dolly comprising a rectangular chassis and four winches:

wherein said rectangular chassis comprises a left side member, a right side member, a front gate member, and a back gate member, whereby said left side member and said right side member each comprise a first vertical post and a second vertical post rigidly interconnected by a top cross member and a bottom cross member, and said front gate member and said back gate member each comprise a first vertical beam and a second vertical beam rigidly interconnected by a top cross member and a bottom cross member, wherein said first vertical beam of said front gate member provides a means for pivotal, detachable attachment to said first vertical post of said left side member, whereby a fixed angle is formed between said front gate member and said left side member;

wherein said second vertical beam of said front gate member provides means for rigid, detachable attachment to said first vertical post of said right side member, whereby a fixed angle is formed between said front gate member and said right side member;

wherein said first vertical beam of said back gate member provides means for pivotal, detachable attachment to said second vertical post of said left side member, whereby a fixed angle is formed between said back gate member and said left side member; and wherein said second vertical beam of said back gate member provides means for rigid, detachable attachment to said second vertical post of said right side member, whereby a fixed angle is formed between said back gate member and said right side member; and wherein said four winches each provide for swivable attachment to the top of one or more of said vertical posts and provide a means for connection of a lifting element thereto.

3. The unit dolly of claim 2 wherein the means for pivotal, detachable attachment of said first vertical beam of said front gate member to said first vertical post of said left side member comprise a hinge:

wherein said hinge is rigidly affixed to said first vertical post of said left side member;

wherein said hinge is rotatably connected to said first vertical beam of said front gate member;

wherein said hinge provides for axial rotation of the vertical beam of the front gate member; and wherein said hinge precludes movement of said vertical beam of said front gate member along the axis of said first vertical post of said left side member.

4. The unit dolly of claim 2 wherein the means for detachable attachment of said first vertical post of said right side member to said second vertical beam of said front gate member comprises an anchor coupling:

wherein said anchor coupling is rigidly affixed to said first vertical post of said right side member;

said anchor coupling provides an aperture;

wherein an elongated tube is attached to said second vertical beam of said front gate member; and whereby alignment of said elongated tube under said aperture provides for insertion of a pin through said aperture and into said elongated tube; and wherein insertion of said pin provides for rigid attachment of said first vertical post of said right side member to said second vertical beam of said front gate member.

5. A method for assembling said unit dolly of claim 2 comprising, in any order, the steps of:

attaching said first vertical beam of said front gate member to said first vertical post of said left side member;

attaching said second vertical beam of said front gate member to said first vertical post of said right side member;

attaching said first vertical beam of said back gate member to said second vertical post of said left side member; and attaching said second vertical beam of said back gate member to said second vertical post of said right side member.

6. A method for hoisting an object to be moved with the unit dolly of claim 2 comprising the steps of:

positioning said unit dolly adjacent to said object to be moved;

configuring said unit dolly to receive said object to be moved by detaching said second vertical beam of said front gate member from said first vertical post of said right side member, and rotating said second vertical beam of said front gate member away from said first vertical post of said right side member until an opening is formed between said second vertical beam of said front gate member and said right side member that is capable of receiving said object to be moved;

repositioning said unit dolly until the inner periphery of said unit dolly encompasses the outer periphery of said object to be moved;

configuring said unit dolly to hoist said object to be moved by rotating said second vertical beam of said front gate member adjacent to said first vertical post of said right side member, rigidly attaching said second vertical beam to said first vertical post of said right side member, positioning said lifting elements to hoist said object to be moved; and hoisting said object to be moved by activating said winches.

* * * * *